US008424248B2

(12) United States Patent
Uken et al.

(10) Patent No.: US 8,424,248 B2
(45) **Date of Patent: *Apr. 23, 2013**

(54) METHOD OF INSTALLING A LOCKING BALANCE SHOE AND SYSTEM FOR A PIVOTABLE WINDOW

(75) Inventors: Stuart J. Uken, Sioux Falls, SD (US); Gary R. Newman, Valley Spring, SD (US); Lawrence J. Versteeg, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 363 days.

This patent is subject to a terminal disclaimer.

(21) Appl. No.: 12/690,266

(22) Filed: Jan. 20, 2010

(65) Prior Publication Data

US 2010/0115854 A1 May 13, 2010

Related U.S. Application Data

(60) Division of application No. 11/654,120, filed on Jan. 17, 2007, which is a continuation of application No. 11/101,689, filed on Apr. 8, 2005, now Pat. No. 7,191, 562, which is a continuation of application No. 10/862, 950, filed on Jun. 8, 2004, now Pat. No. 6,931,788, which is a continuation of application No. 10/446,279, filed on May 23, 2003, now Pat. No. 6,820,368, which is a continuation of application No. 10/044,005, filed on Jan. 11, 2002, now Pat. No. 6,679, 000.

(60) Provisional application No. 60/261,501, filed on Jan. 12, 2001.

(51) Int. Cl.
*E06B 3/00* (2006.01)

(52) U.S. Cl.
USPC ..... 49/506; 49/181; 49/176; 49/445

(58) Field of Classification Search ..... 49/181, 49/176, 446, 183, 184, 185, 186, 445, 449, 49/455, 453, 454, 177, 161, 506; 292/DIG. 63, 292/DIG. 47, DIG. 37; 16/197
See application file for complete search history.

(56) References Cited

U.S. PATENT DOCUMENTS 1,007,212 A 10/1911 Lasersohn
1,312,665 A 8/1919 Almquist
(Continued)

FOREIGN PATENT DOCUMENTS

CA 2382933 A1 12/2002
GB 740223 A 11/1955
(Continued)

OTHER PUBLICATIONS

Crossbow Balance! Another New Balance in BSI's Quiver, Balance Systems—BSI, Amesbury Group, Inc., Jun. 7, 1999, 3 pgs.

(Continued)

*Primary Examiner* — Gregory J. Strimbu
(74) *Attorney, Agent, or Firm* — Goodwin Procter LLP

(57) ABSTRACT

A snap lock balance shoe and system to be incorporated in pivotable double hung windows. In one embodiment, the snap lock balance shoe includes a pair of retractable tabs that partially extend through openings within an inverted window balance. Embodiments of methods for installing the system include inserting a frame of the balance shoe within a jamb track of the window jamb, rotating the frame 90 degrees about a first axis, and rotating the frame 90 degrees about a second axis such that the frame is substantially fully disposed within the jamb track.

18 Claims, 13 Drawing Sheets

U.S. PATENT DOCUMENTS

| | | | |
|---|---|---|---|
| 2,178,533 | A | 10/1939 | Viehweger |
| 2,952,884 | A | 9/1960 | Dinsmore |
| 3,007,194 | A | 11/1961 | Griswold |
| 3,105,576 | A | 10/1963 | Jones et al. |
| 3,461,608 | A | 8/1969 | Johnson |
| 3,497,999 | A | 3/1970 | Hendra |
| 3,529,381 | A | 9/1970 | Grossman |
| 3,676,956 | A | 7/1972 | Taylor et al. |
| 3,732,594 | A | 5/1973 | Mills |
| 3,869,754 | A | 3/1975 | Foster |
| 4,028,849 | A | 6/1977 | Anderson |
| 4,068,406 | A | 1/1978 | Wood |
| 4,079,549 | A | 3/1978 | Wood |
| 4,089,085 | A | 5/1978 | Fitzgibbon |
| 4,190,930 | A | 3/1980 | Prosser |
| 4,300,316 | A | 11/1981 | Ficurilli |
| 4,332,054 | A | 6/1982 | Paist et al. |
| 4,506,478 | A | 3/1985 | Anderson |
| 4,510,713 | A | 4/1985 | Anderson |
| 4,610,108 | A | 9/1986 | Marshik |
| 4,697,304 | A | 10/1987 | Overgard |
| 4,704,821 | A | 11/1987 | Berndt |
| 4,930,254 | A | 6/1990 | Valentin |
| 4,941,285 | A | 7/1990 | Westfall |
| 4,949,425 | A | 8/1990 | Dodson et al. |
| 4,958,462 | A | 9/1990 | Cross |
| 5,069,001 | A | 12/1991 | Makarowski |
| 5,127,192 | A | 7/1992 | Cross |
| 5,140,769 | A | 8/1992 | Hickson et al. |
| 5,189,838 | A | 3/1993 | Westfall |
| 5,210,976 | A | 5/1993 | Cripps |
| 5,251,401 | A | 10/1993 | Prete et al. |
| 5,301,467 | A | 4/1994 | Schmidt et al. |
| 5,353,548 | A | 10/1994 | Westfall |
| 5,371,971 | A | 12/1994 | Prete |
| 5,377,384 | A | 1/1995 | Riegelman |
| D355,262 | S | 2/1995 | Chaney et al. |
| 5,445,364 | A | 8/1995 | Tibbals, Jr. |
| 5,448,858 | A | 9/1995 | Briggs et al. |
| 5,452,495 | A | 9/1995 | Briggs |
| 5,463,793 | A | 11/1995 | Westfall |
| 5,530,991 | A | 7/1996 | deNormand et al. |
| 5,553,903 | A | 9/1996 | Prete et al. |
| 5,566,507 | A | 10/1996 | Schmidt et al. |
| 5,572,828 | A | 11/1996 | Westfall |
| 5,615,452 | A | 4/1997 | Habbersett |
| 5,632,117 | A | 5/1997 | Prete et al. |
| 5,632,118 | A | 5/1997 | Stark |
| 5,661,927 | A | 9/1997 | Polowinczak et al. |
| 5,669,180 | A | 9/1997 | Maier |
| 5,697,188 | A | 12/1997 | Fullick et al. |
| 5,704,165 | A | 1/1998 | Slocomb et al. |
| 5,737,877 | A | 4/1998 | Meunier et al. |
| 5,802,767 | A | 9/1998 | Slocomb et al. |
| 5,806,243 | A | 9/1998 | Prete et al. |
| 5,806,900 | A | 9/1998 | Bratcher et al. |
| 5,829,196 | A | 11/1998 | Maier |
| 5,855,092 | A | 1/1999 | Raap et al. |
| 5,873,199 | A | 2/1999 | Meunier et al. |
| 5,924,243 | A | 7/1999 | Polowinczak et al. |
| 5,927,013 | A | 7/1999 | Slocomb et al. |
| 5,943,822 | A | 8/1999 | Slocomb et al. |
| 6,032,417 | A | 3/2000 | Jakus et al. |
| 6,041,475 | A | 3/2000 | Nidelkoff |
| 6,041,476 | A | 3/2000 | deNormand |
| 6,041,550 | A | 3/2000 | Tix |
| 6,058,653 | A | 5/2000 | Slocomb et al. |
| 6,119,398 | A | 9/2000 | Yates, Jr. |
| D434,637 | S | 12/2000 | Habeck et al. |
| 6,155,615 | A | 12/2000 | Schultz |
| 6,161,335 | A | 12/2000 | Beard et al. |
| 6,178,696 | B1 | 1/2001 | Liang |
| 6,226,923 | B1 | 5/2001 | Hicks et al. |
| 6,467,128 | B1 | 10/2002 | Damani |
| 6,470,530 | B1 | 10/2002 | Trunkle |
| D467,490 | S | 12/2002 | Uken et al. |
| 6,622,342 | B1 | 9/2003 | Annes et al. |
| 6,679,000 | B2 | 1/2004 | Uken et al. |
| 6,820,368 | B2 | 11/2004 | Uken et al. |
| 6,840,011 | B2 | 1/2005 | Thompson et al. |
| 7,945,994 | B2 * | 5/2011 | Dallas et al. ..... 16/193 |
| 2002/0092241 | A1 | 7/2002 | Uken et al. |
| 2002/0129463 | A1 | 9/2002 | Newman |
| 2003/0074764 | A1 | 4/2003 | Pettit et al. |
| 2003/0213096 | A1 | 11/2003 | Annes et al. |

FOREIGN PATENT DOCUMENTS

| | | | |
|---|---|---|---|
| GB | 2195691 | A | 4/1988 |
| GB | 2236786 | A | 4/1991 |
| GB | 2280697 | A | 2/1995 |
| GB | 2292168 | A | 2/1996 |
| JP | 63-3785 | | 1/1988 |

OTHER PUBLICATIONS

Heinberg, "Latest Trends in Window and Door Hardware," Shelter Magazine, Jul. 2001, cover and p. 11.

Dakota Balance—Balances and Accessories brochure, May 2001, 2 pgs.

Balance Systems—BSI Amesbury Group, Inc. Crossbow Balance Advertisment dated Jun. 7, 1999, 2 pgs.

Photographs of the Crossbow Balance Component shown in C6, 7 views; 3pgs.

* cited by examiner

METHOD OF INSTALLING A LOCKING BALANCE SHOE AND SYSTEM FOR A PIVOTABLE WINDOW

RELATED APPLICATION

This application incorporates by reference in its entirety and is a division of U.S. patent application Ser. No. 11/654,120, filed Jan. 17, 2007; which incorporates by reference in its entirety and is a continuation of U.S. patent application Ser. No. 11/101,689, filed Apr. 8, 2005, now U.S. Pat. No. 7,191,562; which incorporates by reference in its entirety and is a continuation of U.S. application Ser. No. 10/862,950, filed Jun. 8, 2004, now U.S. Pat. No. 6,931,788; which incorporates by reference in its entirety and is a continuation of U.S. application Ser. No. 10/446,279, filed on May 23, 2003, now U.S. Pat. No. 6,820,368; which incorporates by reference in its entirety and is a continuation of U.S. application Ser. No. 10/044,005, filed on Jan. 11, 2002, now U.S. Pat. No. 6,679,000; which incorporates by reference in its entirety and claims priority to U.S. Provisional Patent Application Ser. No. 60/261,501 entitled Snap Lock Balance Shoe and System for a Pivotable Window filed on Jan. 12, 2001.

FIELD OF THE INVENTION

This invention relates to a window balance system for use in a pivotable window assembly.

BACKGROUND OF THE INVENTION

This invention relates to the field of tilt-in windows. More particularly this invention relates to a balance shoe of a window balance system used in conjunction with a pivot bar mounted on a window sash for rotating the window sash relative to a window frame.

Typical pivotable double hung windows include two window sashes disposed in tracks located in a window frame to allow vertical sliding movement of the sashes. Pivot bars are provided to allow rotational movement of a pivotable window sash about the pivot bars to facilitate cleaning of glazing. To control vertical movement, window balances are used so that the window sashes remain in a position in which they are placed. Balance shoes are used to guide the rotational movement of the window sashes with respect to the window frame. Typically, the balance shoes are coupled to window balances with a connecting member. See, for example, U.S. Pat. No. 6,119,398, entitled "Tilt Window Balance Shoe Assembly with Three Directional Locking" issued to H. Dale Yates, Jr., the disclosure of which is herein incorporated by reference in its entirety.

One of the problems with balance shoes and window balances for pivotable double hung windows is that they are difficult to install. In order to install a pivotable double hung window with balance shoes and window balances, the following installation steps typically must be followed. First, before the window frame is assembled, the balance shoes are inserted into jamb tracks. Next, connecting members are used to attach the balance shoes to the window balances. The balance shoes generally have an opening to accept the pivot bars that are mounted on window sashes. Finally, the sashes are made operable by inserting the pivot bars into the balance shoes and rotating the window sash up to a vertical position in the jamb tracks. The installation process is rather complex and difficult. Repair costs for replacing balance shoes are also significant. In order to change a malfunctioning or failed balance shoe, the jamb tracks either need to be deformed or replaced to gain access to the problematic balance shoe for removal and replacement.

SUMMARY OF THE INVENTION

In general, in one aspect, the invention relates to a balance shoe. The balance shoe includes a frame, a locking member at least partially disposed within the frame, a cam in communication with the locking member, and a connecting device for attaching the balance shoe within a window balance. Embodiments of the invention can include the following features. The connecting device can include one or more retractable tabs that engage the window balance directly. The frame can further include a frame pocket sized to receive a fastener. The cam can include at least one camming surface and a keyhole opening for receiving a pivot bar attached to a window sash. The cam is at least partially housed within the frame and is disposed within a space enclosed by the locking member. Upon rotating the cam with the pivot bar, the locking member engages the window jamb. In one embodiment, the locking member includes two opposing ends integrally connected by a spring member. The cam is located within a space between the opposing ends of the locking member, and upon rotating the cam with the pivot bar, the opposing ends engage the window jamb. In another embodiment, the locking member includes a plate, which is parallel to a back surface of the frame. The cam is located within a space between the plate and the frame such that rotating the cam with the pivot bar forces the plate to engage the window jamb.

In another aspect, the invention relates to an inverted window balance system for use within a pivotable double hung window assembly. The inverted window balance system includes a rigid U-shaped channel with a plurality of openings in the channel walls for securing the contents in the channel, which include an extension spring, a system of pulleys, a cord to connect the extension spring via the system of pulleys with the window sash, and a balance shoe. The balance shoe includes a frame, a locking member at least partially disposed within the frame, a cam in communication with the locking member, and a connecting device for attaching the balance shoe within the rigid U-shaped channel. Embodiments of this aspect of the invention can include the following features. At least a portion of the balance shoe is disposed within the rigid U-shaped channel. The connecting device can include one or more retractable tabs for engaging the rigid U-shaped channel. The retractable tabs can partially extend through at least one of the plurality of openings in the rigid U-shaped channel. The balance shoe can be further secured to the rigid U-shaped channel with a fastener that interfaces with a frame pocket in the balance shoe. The cam can include at least one camming surface and a keyhole opening for receiving a pivot bar attached to a window sash. The cam is at least partially housed within the frame and is disposed within a space enclosed by the locking member. Upon rotating the cam with the pivot bar, the locking member engages the window jamb. In one embodiment, the locking member includes two opposing ends integrally connected by a spring member. The cam is located within a space between the opposing ends of the locking member, and upon rotating the cam with the pivot bar, the opposing ends engage the window jamb. In another embodiment, the locking member includes a plate, which is parallel to a back surface of the frame. The cam is located within a space between the plate and the frame such that rotating the cam with the pivot bar forces the plate to engage the window jamb.

In still another aspect, the invention relates to a method of installing an inverted window balance system within a window jamb in a window frame. The method includes four basic steps. The first step is to provide an inverted window balance system that includes a rigid U-shaped channel with a plurality of openings in the channel walls for securing the contents in the channel, an extension spring and a system of pulleys disposed within the rigid U-shaped channel, a cord to connect the extension spring via the system of pulleys with the window sash, and a balance shoe. The balance shoe includes a frame, a locking member located at least partially within the frame, a cam in communication with the locking member, and a connecting device for attaching the balance shoe within the rigid U-shaped channel. The frame of the balance shoe has a frame bottom surface, a frame front surface, and two frame edge surfaces. The second step is to insert the inverted window balance system into a jamb track of the window jamb, such that an axis extending along a longitudinal direction of the rigid U-shaped channel is perpendicular to a back wall of the jamb track and an axis that is perpendicular to the two frame edge surfaces is parallel to the back wall while the frame front surface faces a side wall of the jamb track. The third step is to rotate the window balance system within the jamb track 90 degrees about the axis extending along the longitudinal direction of the rigid U-shaped channel, such that the frame front surface faces in a downward direction. The final step is to rotate the window balance system 90 degrees about the axis that is perpendicular to the two frame edge surfaces, such that the frame bottom surface faces in the downward direction.

These and other features of the invention will be made apparent from the following description taken in conjunction with the accompanying drawings.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF THE INVENTION

Figure 1:
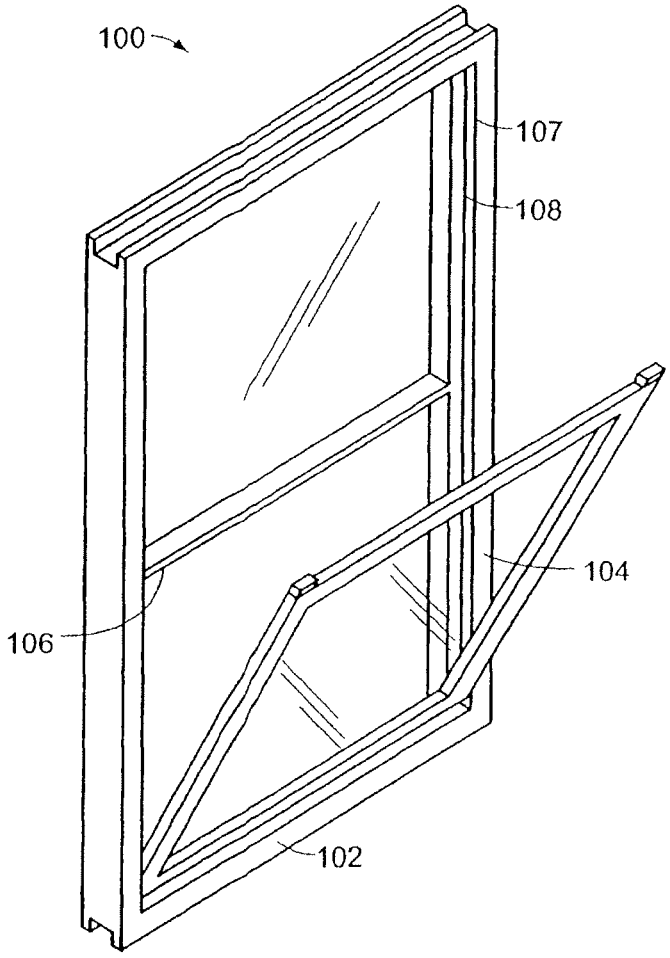
FIG. 1 is a perspective view of a pivotable double hung window assembly.
Figure 9:
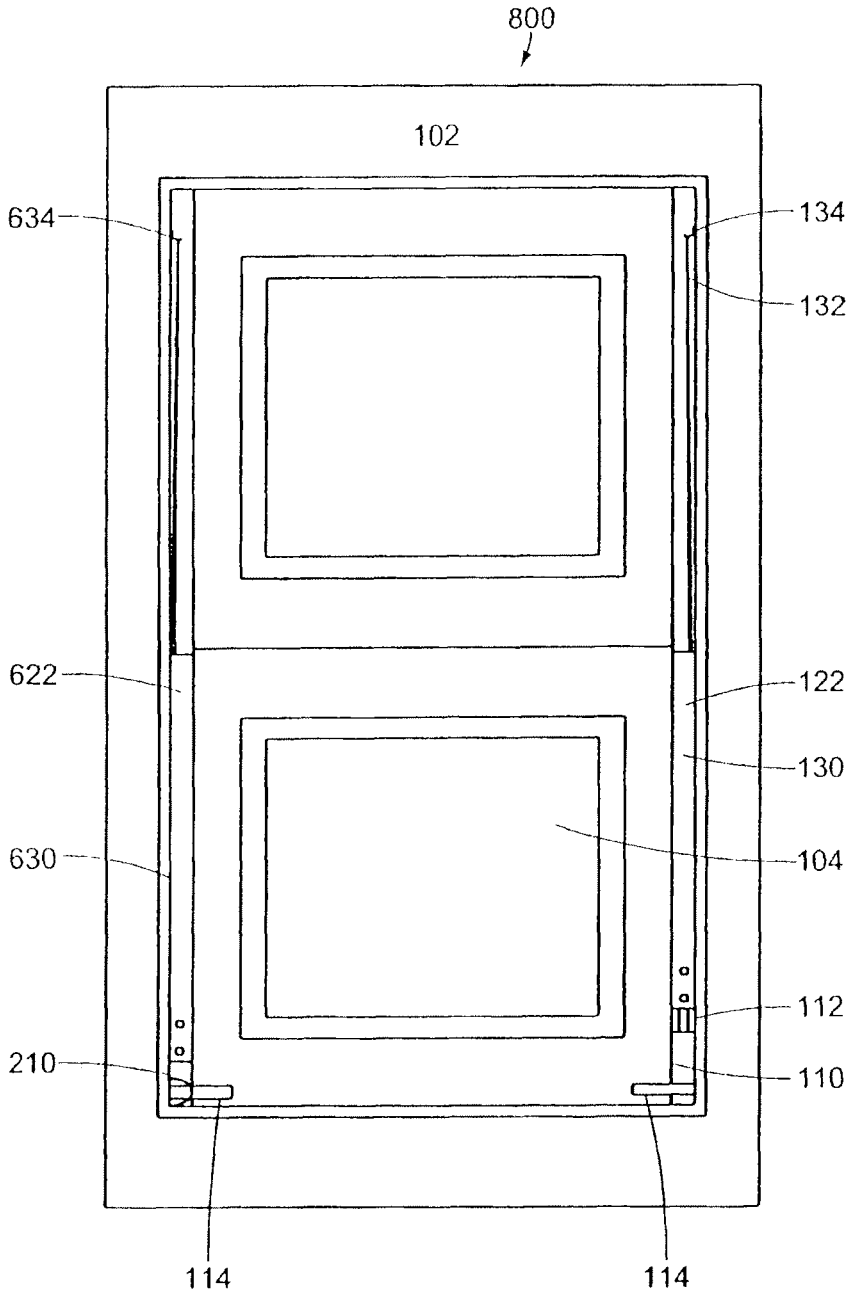
FIG. 9 is a front view of a window assembly including one snap lock inverted window balance system of the present invention and one prior art inverted window balance system installed in a window frame.

Referring to FIG. 1, shown is a pivotable double hung window assembly 100 in which a snap lock balance shoe constructed in accordance with the teachings of the present invention can be used. The pivotable double hung window assembly 100 includes of a window frame 102, a pivotable lower window sash 104, a pivotable upper window sash 106, and a window jamb 107. The pivotable lower window sash 104 and the pivotable upper window sash 106 slide vertically in jamb track 108 within the window jamb 107, while also being able to pivot about a pivot bar 114, as shown in FIG. 9.

Figure 2A:
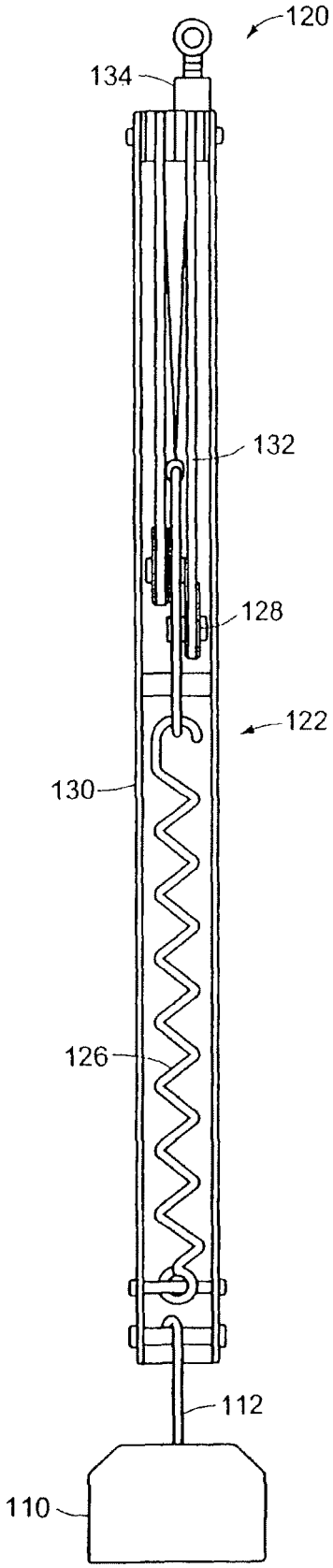
FIG. 2A PRIOR ART
FIG. 2A is a rear view of inverted window balance system for use with a prior art balance shoe.
Figure 2B:
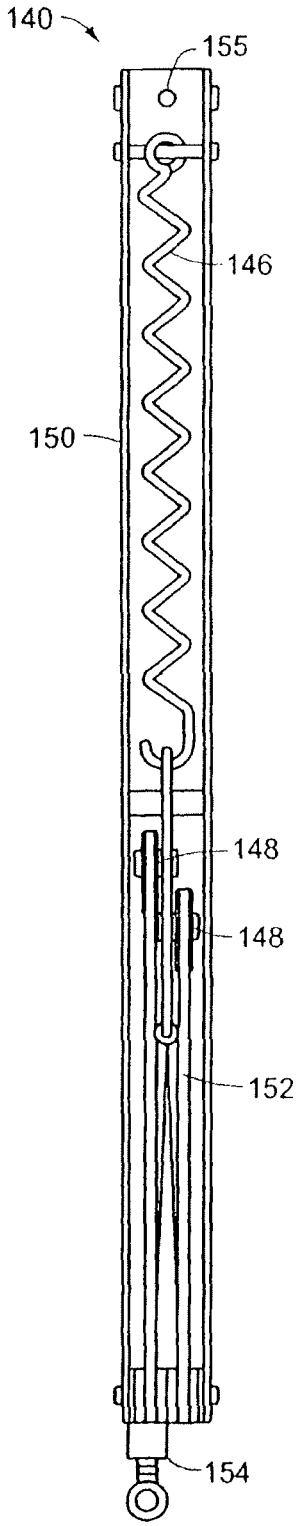
FIG. 2B is a rear view of a window balance.

FIG. 2A shows a rear view of an inverted window balance system 120 for use in the pivotable double hung window assembly 100. The inverted window balance system 120 includes an inverted window balance 122 used for balancing the weight of either the pivotable lower window sash 104 or the pivotable upper window sash 106 at any vertical position within the window frame 102, and a prior art balance shoe 110 for guiding the rotation of the pivotable lower window sash 104 about the pivot bar 114. A hanging connector 112 connects the prior art balance shoe 110 to the inverted window balance 122. The inverted window balance 122 includes an extension spring 126 connected to a system of pulleys 128 housed within a rigid U-shaped channel 130, and a cord 132 for connecting the system of pulleys 128 to a jamb mounting attachment 134. The jamb mounting attachment 134 is used for connecting the inverted window balance system 120 to the window jamb 107. One difference between the inverted window balance 122 and a window balance 140, shown in FIG. 2B, includes the placement of the extension spring 146 above a system of pulleys 148 within the rigid U-shaped channel 150. A cord 152 connects the system of pulleys 148 to a jamb mounting attachment 154. Another difference is that while inverted window balances 122 travel with either the pivotable lower window sash 104 or pivotable upper window sash 106, the window balance 140 remains in a fixed position in the window jamb 107 due to an attachment to the window jamb 107 through an attachment opening 155.

Figure 3A:
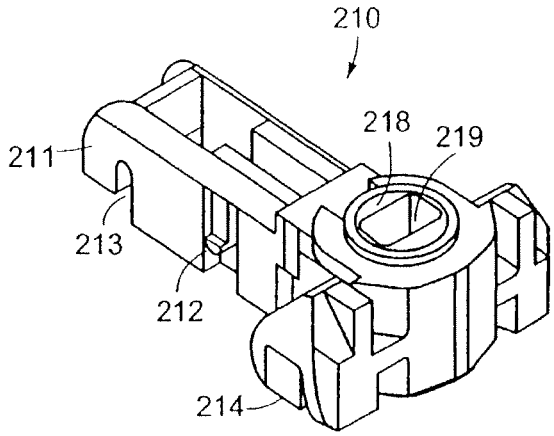
FIG. 3A is one perspective view of an embodiment of a snap lock balance shoe of the present invention.
Figure 3B:
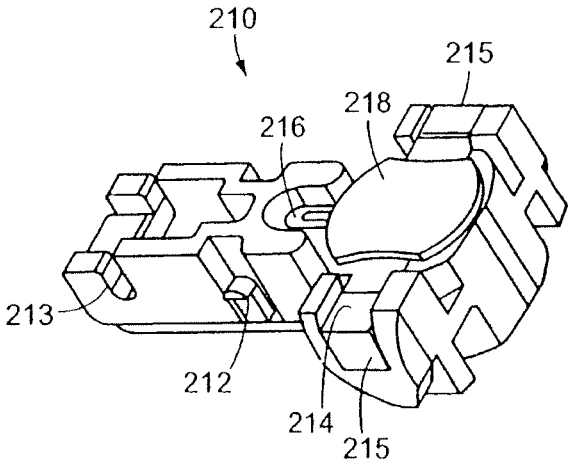
FIG. 3B is another perspective view of the embodiment of the snap lock balance shoe of FIG. 3A.
Figure 3C:
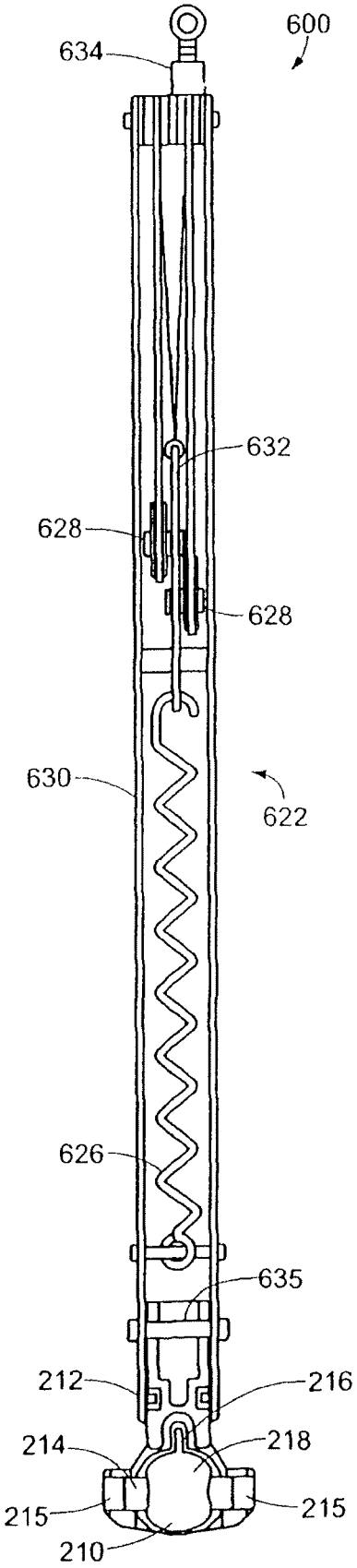
FIG. 3C is a rear view of one embodiment of a snap lock inverted balance system.

FIGS. 3A and 3B are perspective views of a snap lock balance shoe 210 of one embodiment of the present invention. The snap lock balance shoe 210 has a frame 211 in which is housed a connecting device 212, a locking device 214, and a cam 218. The connecting device 212 can be integral with the frame 211 and attaches the snap lock balance shoe 210 directly within an inverted window balance 622, shown in FIG. 3C. The inverted window balance 622 in combination with the snap lock balance shoe 210 forms a snap lock inverted window balance system 600. The inverted window balance 622 includes an extension spring 626 connected to a system of pulleys 628 housed within a rigid U-shaped channel 630, and a cord 632 for connecting the system of pulleys 628 to a jamb mounting attachment 634, such as a cord terminal or hook.

In the depicted embodiment, the connecting device 212 is a pair of retractable tabs that snap into the rigid U-shaped channel 630. In other embodiments, other connecting devices such as a screw, may be used to secure the frame 211 to the rigid U-shaped channel 630. A fastener 635 located in the inverted window balance 622 can be used to further secure the connection between the snap lock balance shoe 210 and the inverted window balance 622. To accommodate the fastener 635, the snap lock balance shoe 210 can form a connection pocket 213 sized to receive or mate with the fastener 635.

Another element of the snap lock balance shoe 210 visible in FIG. 3A is a keyhole opening 219 located within the cam 218. The keyhole opening 219 is sized to accept the pivot bar 114 extending from either the pivotable lower window sash 104 or the pivotable upper window sash 106, and serves as a connection point between the pivotable lower or upper window sash 104, 106 and the snap lock balance shoe 210. FIG. 3B shows a perspective view of the snap lock balance shoe 210 showing another face of the cam 218.

In the embodiment shown in FIG. 3B, the locking device 214 surrounds the cam 218 and includes of a pair of opposing ends 215 connected by a spring member 216. When the pivotable lower window sash 104 is tilted open, the pivot bar 114 rotates, which in turn rotates the cam 218 forcing the opposing ends 215 outward to engage the jamb track 108 of the window frame 102, thereby locking the balance shoe 210 in that location.

Figure 3D:
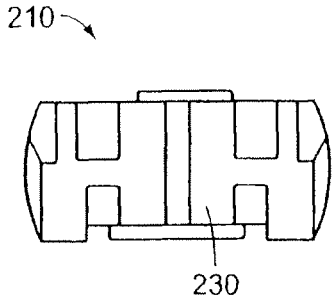
FIG. 3D is a bottom view of one embodiment of a snap lock balance shoe.
Figure 3E:
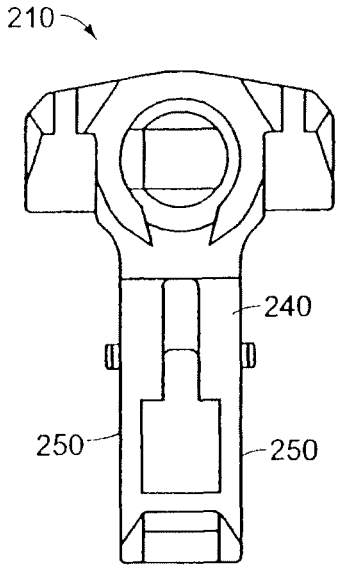
FIG. 3E is a front view of one embodiment of a snap lock balance shoe.
Figure 3F:
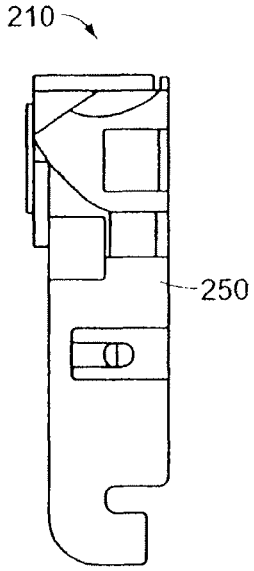
FIG. 3F is a side view of one embodiment of a snap lock balance shoe.

FIGS. 3D-3F show different views of one of the embodiments of the snap lock balance shoe 210 of the invention. FIG. 3D is a bottom view of the snap lock balance shoe 210 that shows a frame bottom surface 230. FIG. 3E is a front view of the same embodiment of the snap lock balance shoe 210 that illustrates a frame front surface 240, and FIG. 3F is an side view that shows one of the two frame edge surfaces 250 of the snap lock balance shoe 210.

Figure 4:
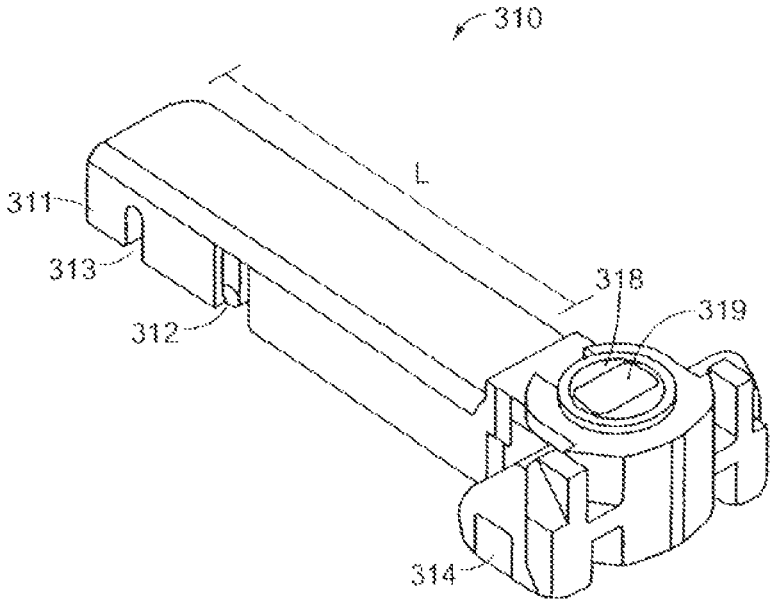
FIG. 4 is a perspective view of an embodiment of a snap lock balance shoe of the present invention.

FIG. 4 shows another embodiment of a snap lock balance shoe 310. The snap lock balance shoe 310 has an elongated frame 311 in which is housed a connecting device 312, a locking device 314, and a cam 318. Within the cam is a keyhole opening 319 sized to receive the pivot bar 114. The elongated frame 311 has a length L that is greater than about 1.25 inches. When attached to the rigid U-shaped channel 630, the balance shoe 310 extends further outward from the rigid U-shaped channel 630 than the balance shoe 210 attached to a similar sized rigid U-shaped channel 630. The balance shoe 310 allows a fixed-sized rigid U-shaped channel 630 to be used in a larger window having a greater travel distance by extending the length of the entire window balance system by having a longer balance shoe 310. One of the advantages of the present invention is that an installer can create a custom window balance system for a particular window by fitting a fixed-length rigid U-shaped channel 630 with an appropriately sized snap lock balance shoe.

FIG. 4 shows another embodiment of a snap lock balance shoe 310. The snap lock balance shoe 310 has an elongated frame 311 in which is housed a connecting device 312, a locking device 314, and a cam 318. Within the cam is a keyhole opening 319 sized to receive the pivot bar 114. The elongated frame 311 has a length L 325 that is greater than about 1.25 inches. When attached to the rigid U-shaped channel 630, the balance shoe 310 extends further outward from the rigid U-shaped channel 630 than the balance shoe 210 attached to a similar sized rigid U-shaped channel 630. The balance shoe 310 allows a fixed-sized rigid U-shaped channel 630 to be used in a larger window having a greater travel distance by extending the length of the entire window balance system by having a longer balance shoe 310. One of the advantages of the present invention is that an installer can create a custom window balance system for a particular window by fitting a fixed-length rigid U-shaped channel 630 with an appropriately sized snap lock balance shoe.

Figure 5A:
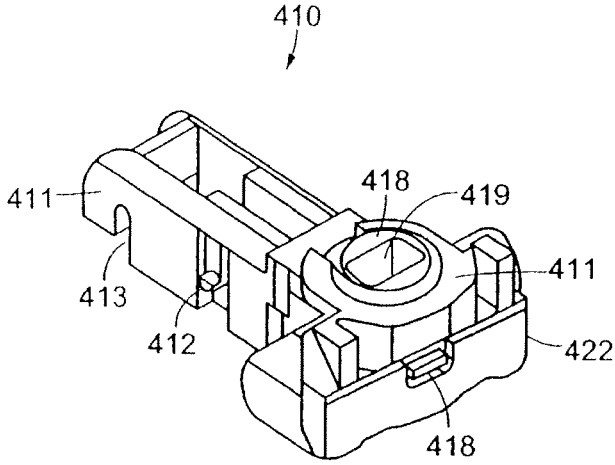
FIG. 5A is one perspective view of another embodiment of a snap lock balance shoe of the present invention.
Figure 5B:
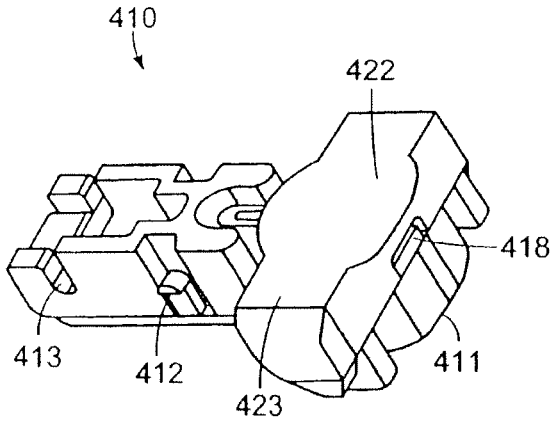
FIG. 5B is another perspective view of the embodiment of the snap lock balance shoe of FIG. 5A.

Referring to FIGS. 5A-5B, shown is another embodiment of the present invention of a snap lock balance shoe 410. The snap lock balance shoe 410 has a locking member 422 which engages a back wall of the jamb track 108 locking the balance shoe 410 in that location. The locking member 422 is partially disposed in the frame 411 and includes a plate 423 that engages the back wall of the jamb track 108. The balance shoe 410 also includes a frame 411, a connecting device 412, and a cam 418. The cam 418 is partially disposed within the frame 411 in a space enclosed by the locking member 422. The cam 418 includes a keyhole opening 419 sized to receive the pivot bar 114. Upon rotation of the cam 418 with the pivot bar 114, the locking member 422 is forced away from the frame 411 towards the back wall of the jamb track 108, thereby anchoring the balance shoe 410 in that location within the window frame 102.

Figure 6A:
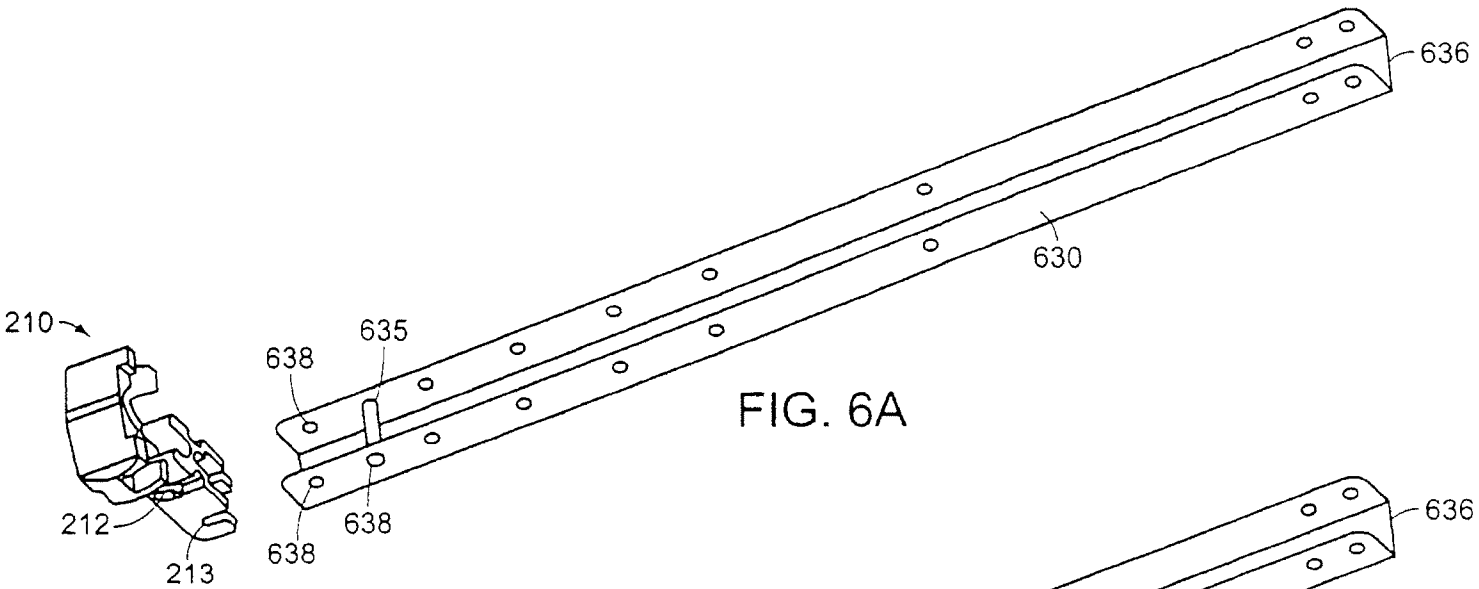
FIG. 6A is a perspective view of one embodiment of a balance shoe of the invention and a rigid U-shaped channel.
Figure 6B:
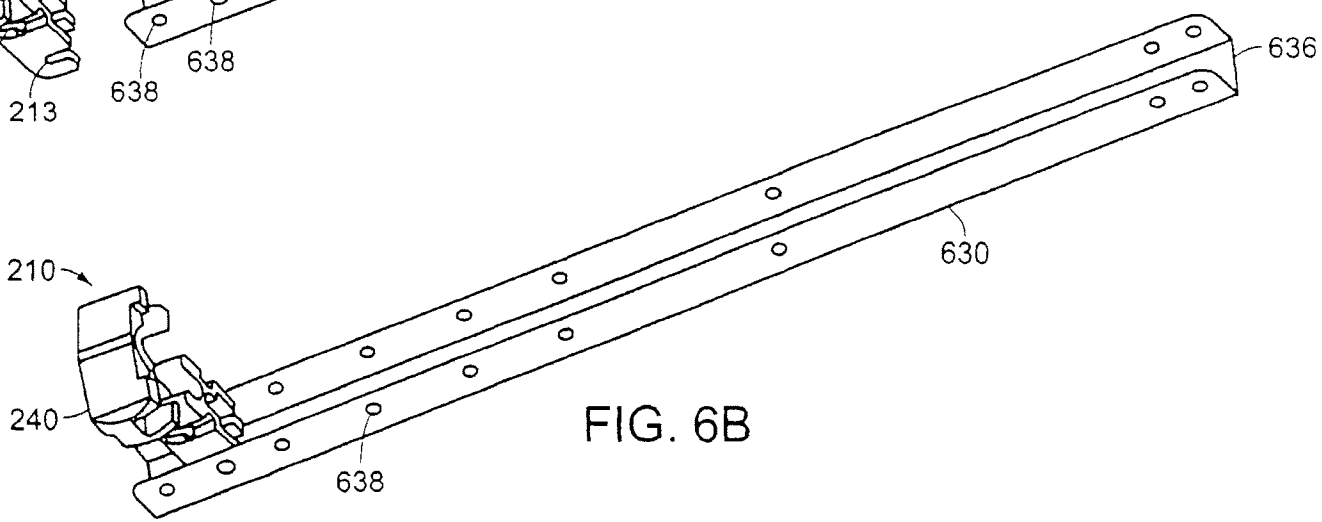
FIG. 6B is a perspective view showing the first step of connecting one embodiment of the balance shoe of the invention to the rigid U-shaped channel.
Figure 6C:
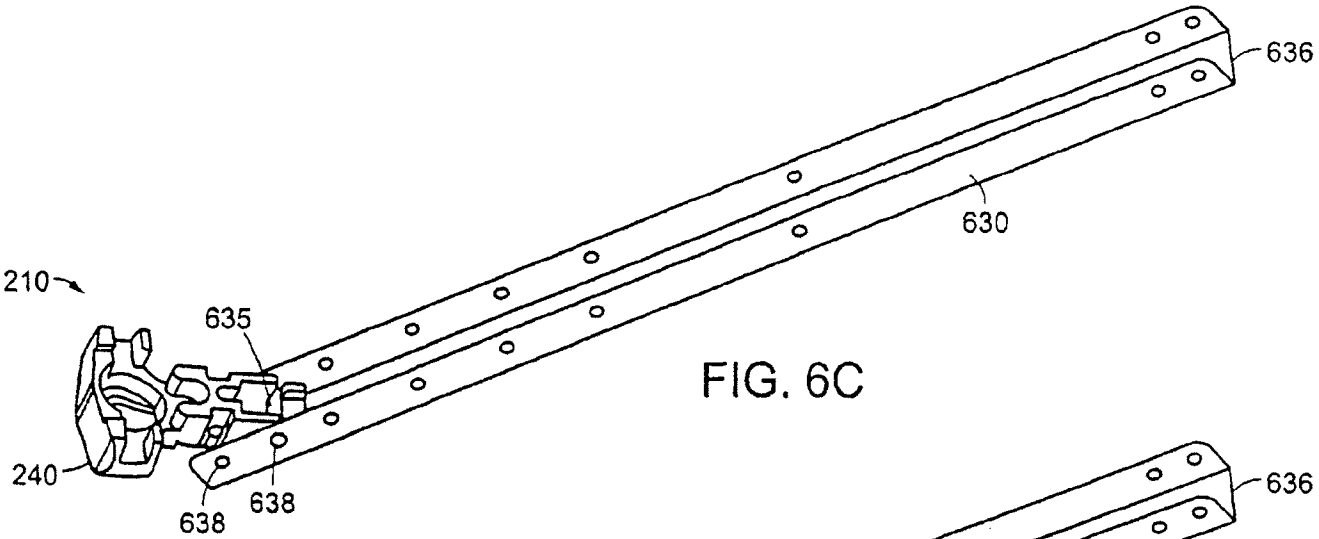
FIG. 6C is a perspective view showing the second step of connecting one embodiment of the balance shoe of the invention to the rigid U-shaped channel.
Figure 6D:
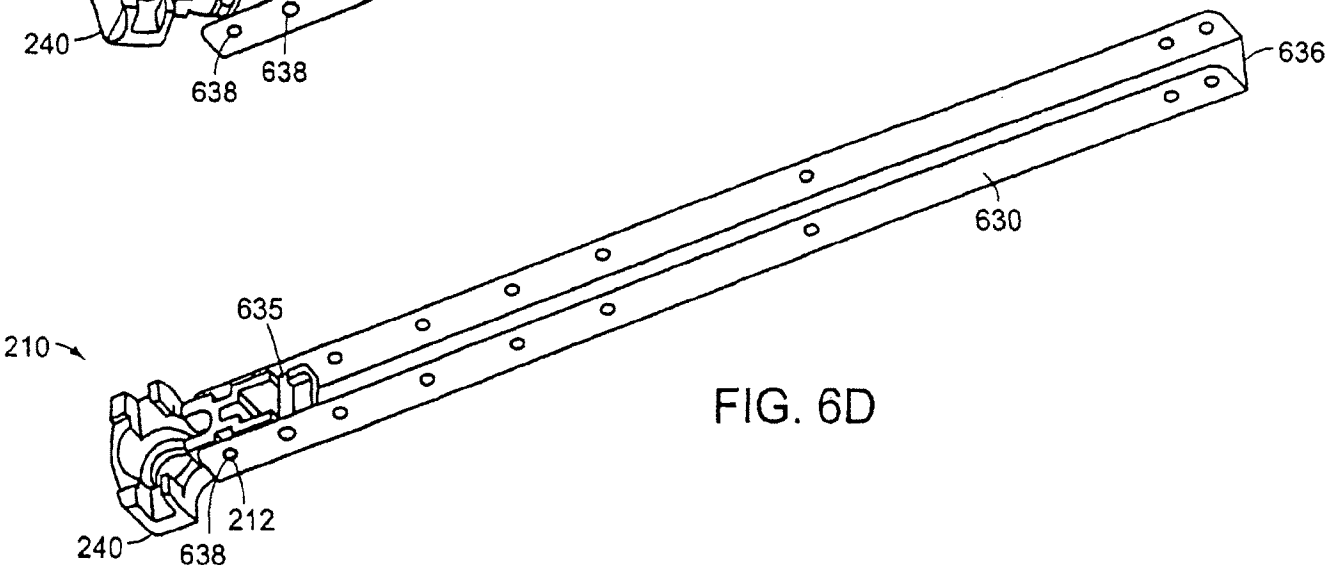
FIG. 6D is a perspective view showing one embodiment of the balance shoe of the invention connected to the rigid U-shaped channel.

FIGS. 6A-6D show one embodiment of a method for securing the snap lock balance shoe 210 within a rigid U-shaped channel 630 with multiple openings 638. It should be noted that each opening 638 on one side of the rigid U-shaped channel 630 has a corresponding opening 638 on the other side of the rigid U-shaped channel 630 to form a pair of openings. The first step, shown in FIG. 6A, is to place a fastener 635, such as a rivet, in one of the pairs of openings 638 in the rigid U-shaped channel 630. The next step, as depicted in FIG. 6B, is to slide the snap lock balance shoe 210 into the rigid U-shaped channel 630 such that the fastener 635 is received in the connection pocket 213 of the snap lock balance shoe 210. As shown in FIG. 6C, the snap lock balance shoe 210 is then rotated down so that the front frame surface 240 is aligned with a bottom wall 636 of the rigid U-shaped channel 630. FIG. 6D shows the last step of attaching the snap lock balance shoe 210 within the rigid U-shaped channel 630. In this step, the connecting device 212 of the snap lock balance shoe 210 snaps into one of the pairs of openings 638 located on the rigid U-shaped channel 630. In alternative embodiments the connection device 212 of the snap lock balance shoe 210 can extend through off-set openings in the rigid U-shaped channel 630. In some embodiments, the snap lock balance shoe 210 is attached to the rigid U-shaped channel 630 with the fastener 635. In other embodiments, the snap lock balance shoe 210 is attached to the rigid U-shaped channel 630 without the fastener 635. It should also be noted that in some embodiments, the snap lock balance shoe 210 can be aligned and secured to the rigid U-shaped channel 630 such that the front frame surface 240 faces upwards instead of downwards as depicted in FIG. 6D.

Figure 7A:
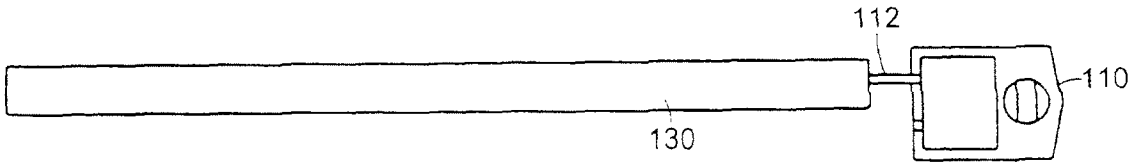
FIG. 7A PRIOR ART
FIG. 7A is a front view of a prior art balance shoe attached to a rigid U-shaped channel.
Figure 7B:
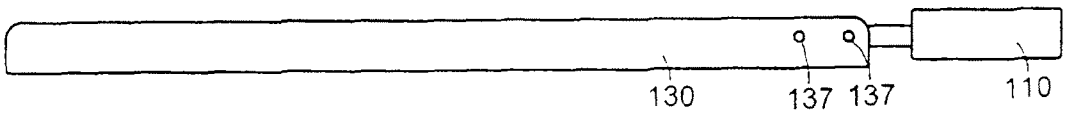
FIG. 7B PRIOR ART
FIG. 7B is a side view of the prior art balance shoe attached to the rigid U-shaped channel.

FIG. 7A is a front view of the prior art balance shoe 110 attached to the rigid U-shaped channel 130. The rigid U-shaped channel 130 is connected to the prior art balance shoe 110 by the hanging connector 112. No part of the prior art balance shoe 110 lies within the rigid U-shaped channel 130. FIG. 7B is a side view of the prior art balance shoe 110 attached to the rigid U-shaped channel 130 illustrating channel openings 137. Fasteners (not shown) are installed through the channel openings 137 to secure the hanging connector 112 to the rigid U-shaped channel 130.

Figure 8A:
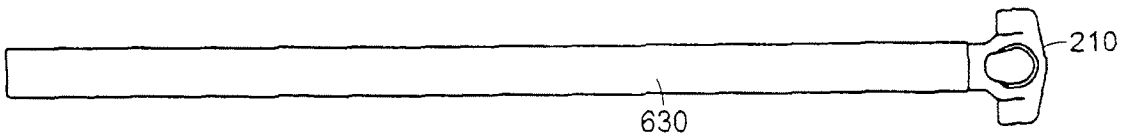
FIG. 8A is a front view of one embodiment of a snap lock balance shoe of the present invention attached to a rigid U-shaped channel.
Figure 8B:
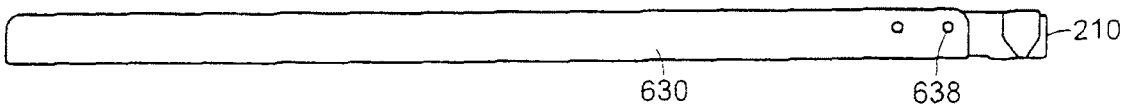
FIG. 8B is a side view of one embodiment of the snap lock balance shoe of the present invention attached to the rigid U-shaped channel.

Referring to FIGS. 8A and 8B, shown is an embodiment of the snap lock balance shoe 210 of the present invention attached to the rigid U-shaped channel 630. The snap lock balance shoe 210 is directly attached within the rigid U-shaped channel 630 by a connecting device 212 located on the frame 211 of the snap lock balance shoe 210. The connecting device 212 extends through a pair of openings 638 located on the rigid U-shaped channel 630.

FIG. 9 is a front view of a pivotable double hung window assembly 800 in which an inverted window balance 122 is attached to a prior art balance shoe 110 by using the hanging connector 112, and the inverted window balance 622 is attached to the snap lock balance shoe 210 of an embodiment of the present invention. Pivot bars 114, as shown in FIG. 9, are secured to the pivotable lower window sash 104. The pivot bars 114 are slidably receivable by both the prior art balance shoe 110 and the snap lock balance shoe 210 and serve as connections between the pivotable lower window sash 104 and respective inverted window balances 122, 622.

An advantage of the type of balance shoe presently disclosed is that the snap lock balance shoe 210 is attached within the rigid U-shaped channel 630 resulting in a longer rigid U-shaped channel 630 than in the inverted balance systems 120 for a given window sash. The longer rigid U-shaped channel 630 of the inverted window balance 622 allows for the use of longer extension springs that provide greater control of the vertical positioning of the window sash than a shorter rigid U-shaped channel 130 with a shorter extension spring. Another advantage of the present invention is that the snap lock balance shoe 210 contains a smaller number of parts than prior art balance shoes 110.

Figure 10A:
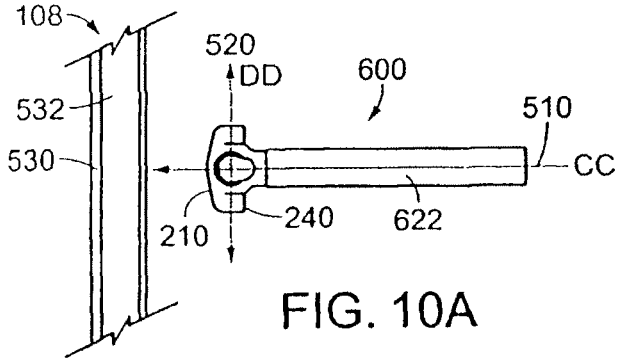
FIG. 10A is a side view illustrating the first step of installing the snap lock inverted window balance system of the invention into the jamb track.
Figure 10B:
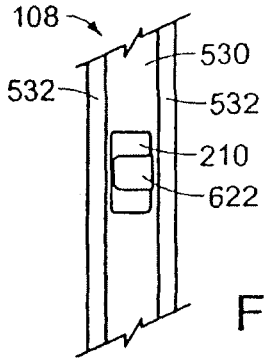
FIG. 10B is a front view illustrating the first step of installing the snap lock inverted window balance system of the invention into the jamb track.
Figure 11A:
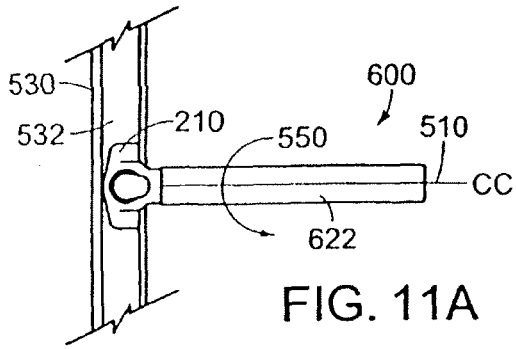
FIG. 11A is a side view illustrating the second step of installing the snap lock inverted window balance system of the invention into the jamb track.
Figure 11B:
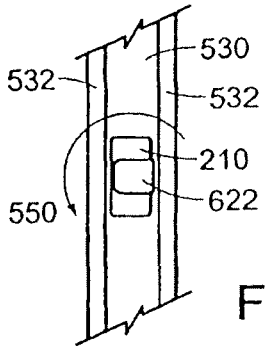
FIG. 11B is a front view illustrating the second step of installing the snap lock inverted window balance system of the invention into the jamb track.
Figure 12A:
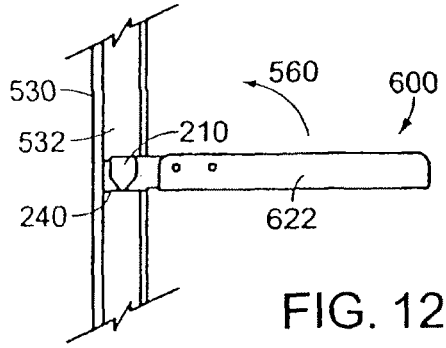
FIG. 12A is a side view illustrating the third step of installing the snap lock inverted window balance system of the invention into the jamb track.
Figure 12B:
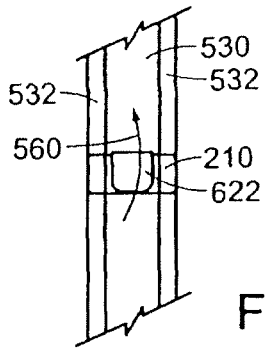
FIG. 12B is a front view illustrating the third step of installing the snap lock inverted window balance system of the invention into the jamb track.
Figure 13A:
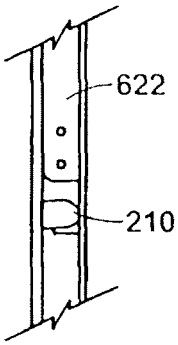
FIG. 13A is a side view illustrating the last step of installing the snap lock inverted window balance system of the invention into the jamb track.
Figure 13B:
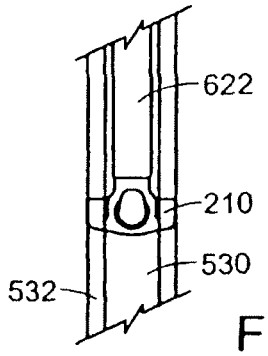
FIG. 13B is a front view illustrating the last step of installing the snap lock inverted window balance system of the invention into the jamb track.

One installation method used to place a snap lock inverted window balance system 600 within the jamb tracks 108 is schematically illustrated in the remaining figures. The snap lock inverted window balance system 600 includes one inverted window balance 622 and one snap lock window balance 210. FIGS. 10A, 11A, 12A, and 13A show the installation method from a side view, while FIGS. 10B, 11B, 12B, and 13B show the method from a front view. The installation method involves an orientation step, a first rotation step, and a second rotation step. FIGS. 10A and 10B show the orientation step in the installation method. In the orientation step, the snap lock inverted window balance system 600 is inserted the jamb tracks 108 such that an axis CC 510 in FIG. 10A is perpendicular to a back wall 530 of the jamb tracks 108, while an axis DD 520 in FIG. 10A is parallel to the back wall 530 and the frame front surface 240 is adjacent to a side wall 532 of the jamb tracks 108. FIGS. 11A and 11B show the snap lock inverted window balance system 600 inserted in the jamb tracks 108 as well as an arrow 550 indicating the direction of rotation of the snap lock inverted window balance system 600 required to complete the first rotation step. The first rotation step involves rotating the snap lock inverted window balance system 600 90-degrees about the axis CC 510 such that the frame front surface 240 faces downward. FIGS. 12A and 12B show the snap lock inverted window balance system 600 after the 90-degree rotation around the axis CC 510 has been completed. The second rotation step involves a 90-degree rotation about the axis DD 520. An arrow 560 showing the direction of the second rotation step is shown in FIGS. 12A and 12B. FIGS. 13A and 13B show in two different views the snap lock inverted window balance system 600 after the installation method has been completed. The cord terminal or any other jamb mounting attachment 634 (see FIG. 9) can then be screwed or hooked into place to anchor the snap lock inverted window balance system 600.

The installation method just described can be carried out in reverse to remove the snap lock inverted window balance system 600 from the jamb track 108 of the window frame 102 to allow for easy replacement of the snap lock balance shoe 210 or the snap lock inverted window balance system 600 itself. In order to replace inverted window balance systems 120 with prior art balance shoes 110, either the jamb tracks 108 need to be warped or completely removed in order to replace the prior art balance shoe 110 of the inverted window balance system 120.

While there have been described several embodiments of the invention, other variants and alternatives will be obvious to those skilled in the art. Accordingly, the scope of the invention is not limited to the specific embodiments shown.

What is claimed is:

1. A method of installing an inverted window balance system within a window jamb in a window frame, the method comprising the steps of:

providing the inverted window balance system comprising:

a U-shaped channel; and a balance shoe comprising a balance shoe frame;

inserting a portion of the balance shoe frame within a jamb track of the window jamb in an orientation position;

rotating the balance shoe frame about a first axis 90 degrees relative to the orientation position; and rotating the balance shoe frame 90 degrees about a second axis perpendicular to the first axis such that the balance shoe frame is substantially fully disposed within the jamb track.

2. The method of claim 1, wherein the balance shoe frame further comprises:

means for receiving a fastener for pivotally connecting the balance shoe frame to the U-shaped channel; and means for securing the balance shoe frame against rotation relative to the U-shaped channel.

3. The method of claim 2, wherein the receiving means comprises a connecting pocket.

4. The method of claim 3, further comprising the step of pivoting the fastener relative to the connecting pocket.

5. The method of claim 2, further comprising the steps of:

inserting the fastener into the receiving means to connect the shoe to the U-shaped channel;

pivoting the balance shoe frame relative to the U-shaped channel; and securing the balance shoe frame against rotation relative to the U-shaped channel.

6. The method of claim 5, wherein the securing step comprises extending the securing means through an opening defined by the U-shaped channel.

7. The method of claim 5, wherein the pivoting step comprises pivoting the balance shoe frame relative to the U-shaped channel about an axis defined at least in part by the fastener.

8. The method of claim 5, further comprising the step of fixing the fastener to the U-shaped channel.

9. The method of claim 2, wherein the fastener comprises a rivet.

10. The method of claim 2, wherein the securing means comprises resilient tabs.

11. The method of claim 10, wherein the resilient tabs extend from edge surfaces of the balance shoe frame.

12. The method of claim 1, wherein the balance shoe frame further comprises:

a cam at least partially disposed within the balance shoe frame; and a locking member in contact with the cam.

13. The method of claim 12, wherein the locking member is located at edge surfaces of the balance shoe frame.

14. The method of claim 12, wherein the balance shoe frame further comprises a keyhole opening for receiving a pivot bar.

15. The method of claim 12, wherein the locking member comprises a pair of opposing surfaces connected by an elastic member.

16. The method of claim 12, wherein the locking member further comprises a surface adapted to engage the window jamb track.

17. The method of claim 12, wherein rotation of the cam forces the locking member toward side walls of the window jamb track when the balance shoe frame is installed in the window jamb track.

18. The method of claim 1, wherein the balance shoe frame comprises a unitary construction.

* * * * *